United States Patent [19]

Schuster

[11] 4,452,485

[45] Jun. 5, 1984

[54] FLEXIBLE ELASTIC SUPPORT

[76] Inventor: Wilhelm Schuster, Neubauzeile 57, A 4020 Linz-Donau, Austria

[21] Appl. No.: 334,471

[22] Filed: Dec. 23, 1981

Related U.S. Application Data

[62] Division of Ser. No. 51,238, Jun. 22, 1979.

[30] Foreign Application Priority Data

Jun. 23, 1978 [AT] Austria ..... 4599/78

[51] Int. Cl.[3] ..... A47C 25/00

[52] U.S. Cl. ..... 297/284; 297/460

[58] Field of Search ..... 297/284, 460, 231, 452; 5/79, 238, 211; 262/89

[56] References Cited

U.S. PATENT DOCUMENTS

| | | | |
|---|---|---|---|
| 154,454 | 8/1874 | Case | 5/238 |
| 614,153 | 11/1898 | West | 197/231 |
| 825,577 | 7/1906 | Bezanger et al. | 5/72 |
| 2,756,809 | 7/1956 | Endresen | 297/284 |
| 2,843,195 | 7/1958 | Barvaeus | 297/284 |
| 3,158,400 | 11/1964 | Tuhtar | 297/460 |
| 3,378,299 | 4/1968 | Sandor | 297/284 |
| 4,153,293 | 5/1979 | Sheldon | 297/284 |
| 4,350,388 | 9/1982 | Weiner | 297/284 |

FOREIGN PATENT DOCUMENTS

| | | | |
|---|---|---|---|
| 629203 | 10/1961 | Canada . | |
| 655135 | 1/1963 | Canada . | |
| 915834 | 11/1972 | Canada . | |
| 1228432 | 3/1960 | France | 297/284 |
| 361787 | 2/1973 | U.S.S.R. . | |

*Primary Examiner*—Francis K. Zugel

*Attorney, Agent, or Firm*—Karl F. Ross; Herbert Dubno

[57] ABSTRACT

An adjustable-curvature structure, e.g. for seat backs, comprises a pair of support belts which are flexible but substantially inextensible, and a pair of tension belts juxtaposed with the support belts. A grid of transverse bars can span the support belts and a tension device is provided between the two pairs of belts so that the support belts can be bowed when the other belts are placed under tension. The curvature character is controlled by spacers which interconnect the support and tension belts to limit the distance between them at various locations along their lengths.

7 Claims, 40 Drawing Figures

FLEXIBLE ELASTIC SUPPORT

This is a division of application Ser. No. 051,238, filed June 22, 1979.

This invention relates to a flexible elastic support consisting of at least one band of elastic material which in the longitudinal direction is essentially inextensible or not compressible, and a tensioning element which is fixed to the band and arranged substantially parallel to this, on tensioning which the band which is supported on one end or some other position thereof becomes more or less arched or loadable.

SUMMARY OF INVENTION

A supporting structure according to my present invention comprises an elongate flexible and longitudinally substantially inextensible and incompressible band, forming a support belt, and an elongate flexible and generally flat element forming a tension belt, the two belts having mutually confronting broad sides and extending generally codirectionally with each other. The belts are secured to each other at first ends thereof and have second ends engaged by retaining means holding the latter ends close to each other while maintaining the tension belt under stress whereby a convex curvature away from that tension belt is imparted to the support belt with a peak at an unrestrained central portion thereof. I further provide adjustment means coupled with the support belt at an intermediate location disposed between one of its ends and the aforementioned central portion for varying the spacing of the belts from each other at that location, thereby modifying the convex curvature of the support belt.

In an advantageous embodiment, the adjustment means comprises a stiff control belt whose point of engagement with the support belt lies closer to its first end and which traverses the retaining means between the second ends of the two other belts.

Alternatively, the adjustment means may comprise two members anchored to the tension belt and engaging the support belt at different locations separated from each other by the peak of its convex curvature, these members being mechanically interconnected for inversely varying the spacing of the two belts from each other at these two locations.

When the support according to the invention is already installed or mounted, the distance maintaining pieces covered thereby can nevertheless be easily adjusted from outside by the hand-lever mentioned or the like and the curvature displaced.

According to the invention the distance maintaining pieces can simply be bows which embrace the belts transversely to their longitudinal direction.

On the other hand it is according to the invention also possible that the distance maintaining pieces are projections on the support belt or the tensioning belt, which engage in apertures of the tensioning belt or support belt or pass through this or engage round it. With this proposal there is the possibility of manufacturing distance maintaining pieces and the belts from a common starting material, which renders unnecessary the fixing of a separate distance maintaining pieces.

However in this connection the invention also consists in the fact that the apertures of the tensioning belt are slits and that the projections on the support belt may engage in the slits with play. By means of such play it is achieved that on increasing tensioning force in the tensioning belt an increasing curvature before and behind the respective distance maintaining piece arises. If the distance maintaining piece in one case lies at the end of the slit of the tensioning belt, then on a further increase of the tensioning force in the tensioning belt an increase of the curvature takes place only in front of the distance maintaining piece. Depending upon the size and position of the play, there is naturally a comparatively substantial loadability of the support belt before and behind the slit or of the whole support. By lengthening or shortening the cutout quite different curvatures or load receiving abilities can be achieved, with the curvature still being capable of displacement.

A practical embodiment of the invention is characterised in that the above noted projections are double rivets or screws etc. with a central or several separate or unitary distance pieces, against which two or more belts lie. By means of this it is possible to use commercially available rivets, screws, sockets and packing washers, nuts etc. by means of which the construction of these supports according to the invention is further simplified and decreased in cost.

An important feature of the invention consists in the fact that one or more distance maintaining pieces can be displaced and adjusted in their effective length by means of screw threads, scissor-lever arrangements, double wire adjustment devices or by means of eccentrics, hydraulic, pneumatic or Bowden cable type adjustment devices. The distance holders themselves can accordingly be arranged in fixed position relative to one another, that position at which the greatest curvature ought to be being then able to be chosed as desired by the means mentioned.

Another feature of the invention is characterised in that the play between the distance maintaining pieces of the support belt and the slits of the tension belt is of varying size. Also in this case depending upon the size of the play various degrees of loadability of the support can be achieved, but also can be determined at various places of the support belt dependent upon the wish of the user. Obviously a linear increasing or decreasing rise of the amount of play in the tension belt can be undertaken in order to determine the loadability of the support in linear fashion or in other appropriate fashion.

According to a further proposal the invention consists in the fact that between the edge of the aperture or of the end of the slit and the projection or the distance maintaining piece there engages a wedge, eccentric or crooked lever of compressible or incompressible or extensible material or a pneumatic, hydraulic or motor drive element with direct or remote controlled handling, the adjusted position of which can e.g. be fixed. By means of this it is possible with comparatively simple means to introduce at certain places a displacement of the tensioning and support bands opposite to one another, whereby an actual tensioning device for the tensioning belt can be dispensed with. If however a tensioning device is used, then this can be increased or diminished in its action by means of the means mentioned at various places of the support belt.

The invention furthermore contains the important feature that at the projection or distance maintaining piece of the support belt, an adjusting screw held on the tensioning belt engages a wedge, eccentric or the like directly or via an additional inwardly or outwardly lying control belt. This further control belt in such a case bears adjusting screws, wedges or eccentrics and is operable from a position wherein slits in the tensioning belt can be dispensed with since the distance maintaining pieces cooperate directly by the screws, wedges or eccentrics arranged thereto and can be influenced via the control belt.

An important feature of the invention consists in the fact that two or more support-tensioning belts arranged parallel adjacent one another are bonded together by several transverse bars, a grid or by means of a foam or spring core body and accordingly a seat back support, a shoe insert, a mat (mattress or bed insert) a shell construction support element or a large scale support for a bridge construction can be formed. Using the supports according to the invention matlike structures of any desired breadth and width can be manufactured in which curvature can be generated at any place desired or a loadability or elasticity according to desire.

The invention is furthermore characterised in that a tensioning device engages on the one hand with ore or more tensioning belts and on the other on the support belts. With such a tensioning device a more or less large curvature can be generated within some or all of the tensioning and support belts and indeed over the whole length or over parts of the support. The tensioning device is appropriate in cases if, for tensioning the supports, large forces are required, or if relative to the distance maintaining pieces and their control on oppositely running, increasing, pulsing or the like, total or partial arching or loadability, oscillation or the like should be controlled.

Another feature of the invention consists in the fact that the tension belts or an additional tension belt e.g. substantially half the length of the support belts or the like engages on these or on other parts. In this connection "parts" of the support belts can remain uninfluenced or influenced otherwise than the remaining part, wherein by the use of one or more additional tension belts a displacement of the curvature or an alteration of the load ability or of the elasticity of this support or part of the support is possible.

According to the invention it is furthermore possible that one or more tensioning devices engage at one or on several belts or groups of belts. The curvature of a support so constructed can be effected in any variations and combinations.

The invention also consist in the fact that as a tensioning device there engages on the support or tensioning belts a Bowden cable, a crooked lever, wedge, eccentric, a threaded spindle or a compression or tension spring, a hydraulic, pneumatic or motor drive, automatic control by air pressure, photocells, gravity, inertia and other external influences. By means of this simple space and expense spring but wholly effective means can be used, while on requirement for high power, the other drive types can be brought into use, wherein e.g. in the case of remote control of supports built into seat backs a substantial increase in comfort is achieved.

The invention is characterised also in that between the directly neighbouring tensioning and support belts which lie on top of one another or next to one another there are set through going equal length or differing length distance maintaining pieces. By means of this one or several curvatures can be fixed already during manufacture and preparation of the support.

A particular embodiment of the invention is characterised in that as distance maintaining pieces there is provided a tube surrounding the tensioning and support belts with a hollow space in it which is broadened at one or several places into which a section of the support belt in the tensioned condition may spread. By the use of a unitary tube in place of an individual distance maintaining pieces, a further simplification of the support is achieved, wherein however with the same effect curvature at a particular position can be generated. In this connection it is particularly advantageous according to the invention if the tube is arranged slidably on the tensioning and support belts in the longitudinal direction or can be turned around its longitudinal axis, since by means of this measure a displacement of the curvature from one position to another can be effected easily and comfortably.

According to the invention it is furthermore possible that between the distance maintaining pieces and the belts a lubricant or rolls are arranged. This embodiment of the invention is applied when the user has to carry out displacement of the curvature under load.

Another important feature of the invention consists in the fact that the support belts and the transverse bars constitute a unit which is stamped out from a single piece of material or a whole plate or mat and that the tensioning belts as desired either pass through projections of the unit or are held by means of distance maintaining pieces on the unit. By means of this a particularly simple way of manufacturing for the supports according to the invention is given which among one another no longer have to be connected together separately.

The invention can also be seen in the fact that the tension belts engage only at one end or at another place on the grid shaped unit and if desired are connected with a tensioning device.

According to the invention it is also possible that a central tensioning belt can be bordered by two outer support belts and that the tensioning belt and the support belts can be connected together with one another e.g. at one end, that the other end of the tensioning belt is connected with a tensioning device as well as the other ends of the support belts being supported in the region of the tensioning device and that the distance maintaining pieces are e.g. U-shaped, fixed to the support belts and engage underneath the tensioning belt with their bars, wherein the bars are provided with rolls and/or with sliding pieces. This embodiment of the invention is particularly simple to realise since one needs only to start from a common body which contains tensioning and support belts and which e.g. can be made by moulding from plastics. Likewise simple are the respective component parts for the adjusting mechanism. In fact the invention also provides that the U-shaped bow and the support belts constitute a constructional unit, that between the individual bows transverse slits are provided which e.g. are narrower than the bows are wide and that e.g. bows in the region of the tensioning device are higher than the bows which are adjacent the common ends of the tensioning and support belts and that the tensioning device consists of an angled piece with a longitudinal slit for the passage of the tension belt and a slider which can be adjusted transversely to the tension belt by means of a screw thread or the like, which lies against the one side of the shoulder of the angle piece having the longitudinal slit, but at the other side of the shoulder the support belts are supported and that pins on the end of the tension belt which passes through the longitudinal slit in the shoulder lie against wedge-shaped openings of the slider, whereby the screw threaded spindle engages in a thread of the shoulder of the angle piece bent up over a short distance at a right angle or is operable e.g. by means of an eccentric.

Another yet simpler variant of the invention is characterised in that a substantially seat backed shaped body has one or more sections which run in its longitudinal direction i.e. from below to above, that the sections serve for the receipt of tension belts which e.g. at their one ends are fixed to the seat body, fixed with their other ends to a tensioning device and supported over their entire length by distance maintaining pieces which are constructed U-shaped and e.g. fixed to the rear side of the seat back body or prepared in one piece with the seat back body or tension belt. On the other hand, it is possible according to the invention that the tensioning device consists of a slider which is guided in the seat back body transversely to its longitudinal direction having wedge shaped apertures and e.g. of a screwed spindle which passes through a thread in the seat back body and that posts of the tension belts lie against the wedge shaped apertures. Finally the invention can be expressed even more simply and lie in the fact that a body substantially of the shape of a seat back has on its rear side rollers arranged at a distance from one another, that e.g. tension cables fixed e.g. to one of these rollers or to the body are laid in zig-zag fashion around the rollers arranged one after another and appropriately guided from one roll to the lower edge of the seat back body to a tensioning device. It is evident from this that for this variant of the invention the smallest requirements in terms of materials are necessary.

The invention is illustrated in more detail with reference to a few exemplary embodiments in the accompanying drawings. These show:

FIG. 1 a support constructed according to the present invention in perspective view;

FIG. 2 a corresponding side view schematically drawn;

FIG. 3 a side view of a support according to the invention having distance maintaining pieces carrying rollers;

FIGS. 4, 5, 6, 4A, 5A to C and 6A to E various simple embodiments for a tensioning device engaging on the supporting and tensioning belts, in each case shown in perspective and schematically, and FIGS. 17 to 19 inclusive show exemplary embodiments of a tensioning device which is fixed on to the tensioning and support belts, these Figures showing plan and side views or sectional illustrations.

Figure 30:
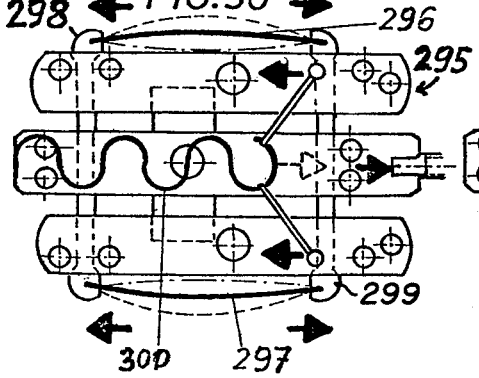
Figure 31:
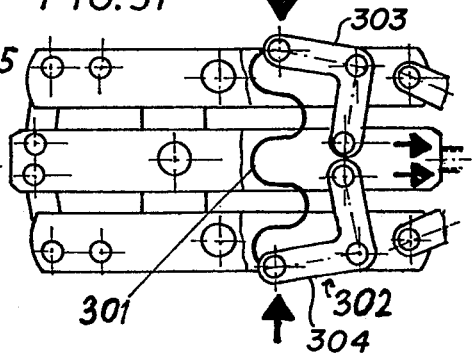

FIGS. 30 and 31 in each case illustrate a tensioning device which may be supported by springs.

Figure 1:
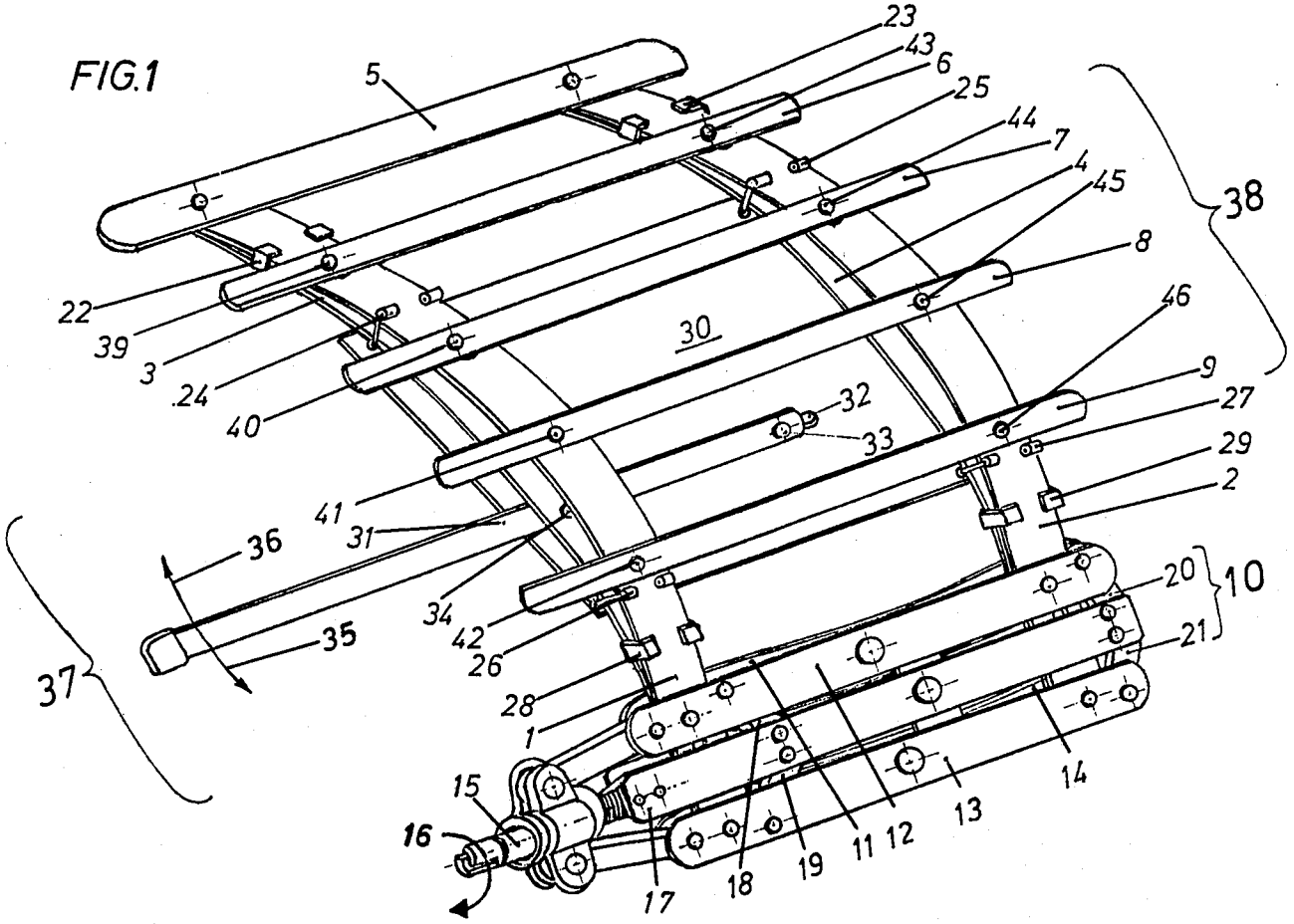

From FIG. 1 it is to be seen that the support constructed according to the invention consists of two upper support belts 1, 2 and two tension belts 3, 4 lying thereunder, which are connected together at their one end by one of a plurality of transverse bars 5 to 9 and are held together at their other ends by means of a scissor lever tensioning device 10, whereof the support belts 1, 2 are fixed to the upper transverse parts 11, 12 and the tensioning belts 3, 4 to the lower transverse parts 13, 14. If the spindle 15 of this tensioning device is turned e.g. in the turning direction of arrow 16 by means of a handle not illustrated or a grip, then scissor levers 18, 19, 20, 21 linked to a central threaded part 17 which is traversed by the spindle, are brought into their extended position so that the transverse parts 11 to 14 which are linked thereto are forced apart from one another. By means of this movement a tension force comes to act on tension belts 3, 4 by means of which the support belts 1, 2 are bent up into the illustrated position.

The tensioning and support belts 1 to 4 are held together by means of several bow-shaped distance maintaining pieces 22 to 29 wherein the central distance pieces 24 to 27 are anchored to a common plate 30, e.g. located below the tension belts, and these permit a greater distance between the tensioning and support belts 1, 3 and 2, 4 respectively than the other distance maintaining pieces 22, 23 and 28, 29. Also the distance maintaining pieces 24 to 27 are provided with rollers which lie on the support belts 1, 2.

A lever-like handle 31 engages on the plate 30 and the engagement is by means of a bolt 33 which passes through a longitudinal slit 32 while the handle is pivoted on tensioning belt 3 at a point 34 around which it may be swung. On swinging handle 31 in the direction of arrow 35 the plate 30 is displaced and accordingly all of the distance maintaining pieces 24 to 27 are displaced upwardly; however on a swinging of handle 31 in the direction of arrow 36, a displacement of the plate 30 downwards takes place.

Since the support belts 1, 2 and/or also the tensioning belts 3, 4 consist of an elastic material which in the longitudinal direction of the strips is substantially inextensible or incompressible, e.g. iron, sheet-steel or plastics, the support belts 1, 2 are bent overall, i.e. over their entire length when a tensioning force engages on the tensioning belts 3, 4. However at the positions where the distance between the distance maintaining pieces in the longitudinal direction of the belts is largest, the support belts can bend most, so that in the arrangement shown in FIG. 1, sections 37 and 38 between the distance maintaining pieces 24 to 26 and 25 to 27 respectively are bent most strongly.

By means of the swinging of handle 31 already mentioned and the consequent displacement of the distance maintaining pieces 24, 27 however, the bowed section 37, 38 can according to desire be displaced upwardly or downwardly.

The transverse bars 6 to 9 are fixed to the support belts by means of bolts 39 to 46 in such a fashion that they are set at a distance from the belts 1, 2 and allow the passage of the rollers of the slidable distance maintenance pieces 24 to 27.

One can easily see that the support illustrated in FIG. 1 can be built into the rear support part of a seat or bench in a lorry or the like and the handle 31 can then project out laterally from the seat back so that simple adjustment of the lever 31 allows matching of the curvature of the back to the back of the person sitting on the seat. As well as this the extent of curvature can be adjusted by turning a likewise laterally arranged (but not illustrated) turning grip which is located on spindle 15 without any difficulty.

By the arrangement of the rollers on the distance maintenance piece is 24 to 27 it is possible to undertake displacement of the curvature 37, 38 even if the tension belts 3 and 4 are tensioned by means of the device 10. Apart from the roller shown, rollers can also be arranged on the plate 30 below the tension belts which guarantee sliding of the plate 30 on the tension belts 3, 4 without too large a friction being generated.

In place of the rollers mentioned, sliding pieces may also be arranged on the ends of the distance maintenance pieces 24 to 27 or between the tension belts 3, 4 and the plate 30.

The handle 31 can naturally be replaced by a hydraulic, pneumatic or motor drive, the actuation means for such a drive being arranged either in the region of the support or at an appropriate distance from this. However, there can also be provided on the plate 30, directly or engaging the handle an eccentric on turning which the displacement of the plate 30 occurs.

Figure 2:
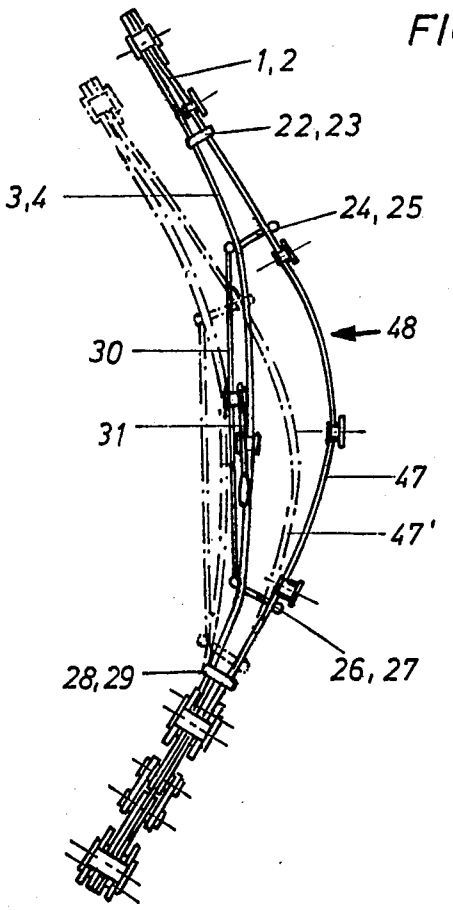

From the embodiment shown in FIG. 2 it can be seen that the distance maintenance pieces 24 to 27 form a curvature 47 in the position shown in FIG. 1, which lies about half-way up the support 48. If however the distance maintenance pieces 24 to 27 are pushed downwardly by swinging the handle 31 in the direction of the arrow 36 (FIG. 1) then the curvature 47' indicated by dash-dot lines is generated, which in this fashion is displaced to the lowest region of the support 48.

Figure 3:
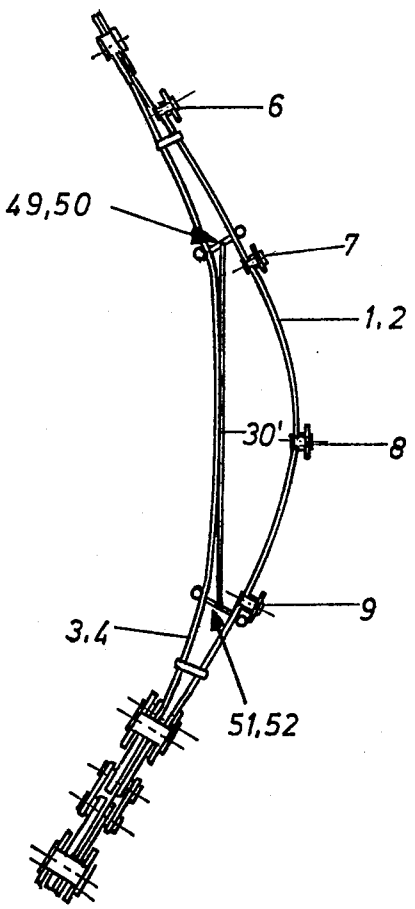

In the case of the embodiment shown in FIG. 3, the plate 30' is arranged between the tension belts 3, 4 and the support belts 1, 2 in such a fashion that the four distance maintenance pieces 49, 50, 51 and 52 connected with it are supported by means of rollers both on the support belts and on the tension belts 1 to 4, and accordingly can slide on these if plate 30 is displaced. The rollers are so small that they are not hindered in their movement on the support belts 1, 2 by the transverse bars 7, 8, 9. A laterally projecting not illustrated handle can be fixed to this plate 30' in similar fashion to that shown in FIG. 1, by means of which the displacement of curvature mentioned may be effected.

Figures 4, 4A, 5, 5A, 5B, 5C, 6, 6A, 6B, 6C, 6D, 6E:
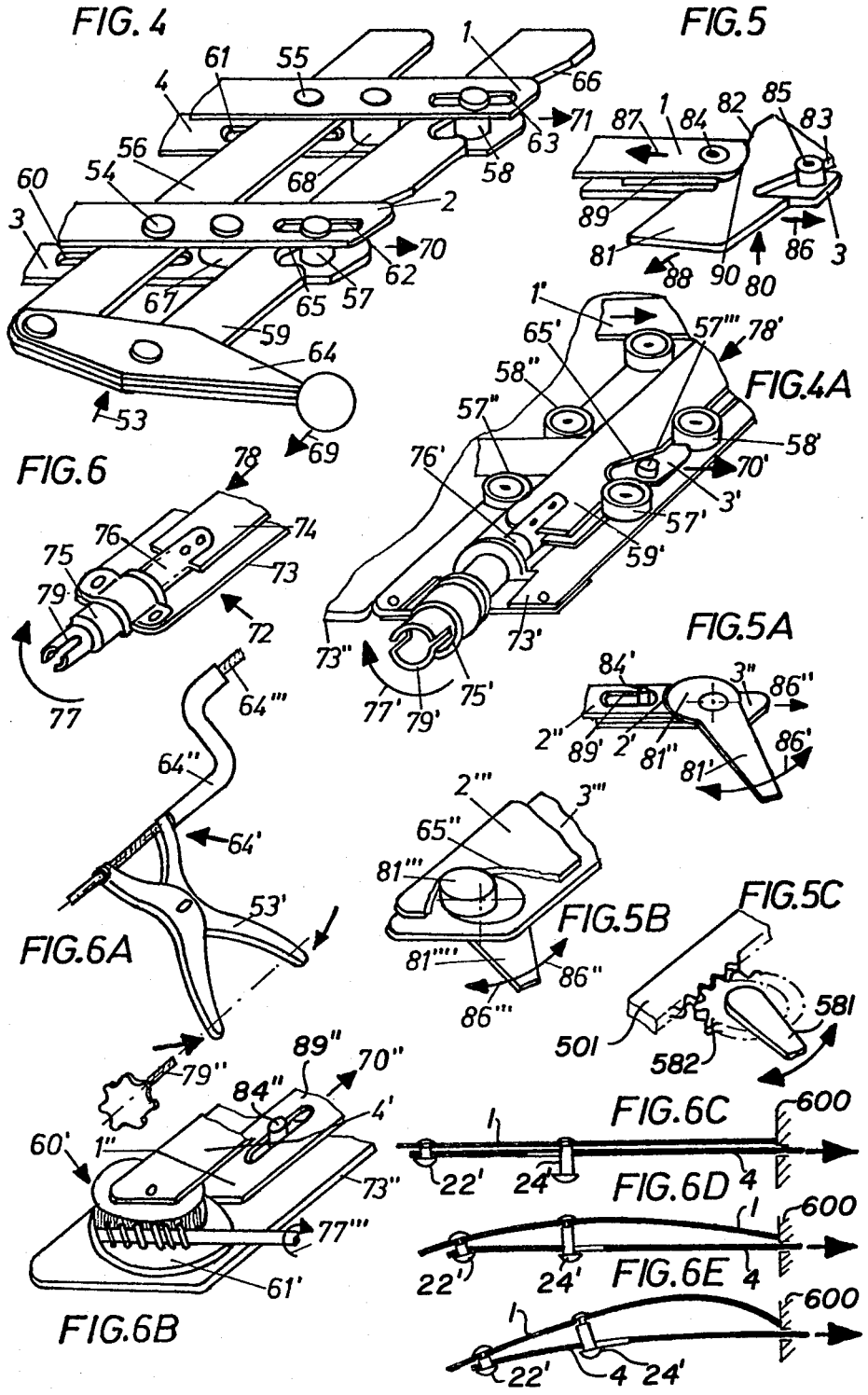

In the support illustrated in perspective in FIG. 4, a simple lever tensioning device 53 engages on the ends of in each case two tension and support belts 1 to 4, which consists of a transverse bar 56 which is fixed to the support belts 1, 2 by means of rivets 54, 55 or the like and a control bar 59 fixed with rivets 57, 58 or the like to the tension belts 3, 4, which is parallel to the transverse bar 56 and as this lies between the tension and support belts 3, 1 or 4, 2. The rivets 54, 55 pass through slots 60, 61 in the tension belts 3, 4 and the rivets 57, 58 pass through slots 62, 63 in the support belts 1, 2. The transverse bar 56 and the control bar 59 are pivotally connected at their one end in each case with a hand lever 64.

The control bar 59 at the regions facing rivets 57, 58 is formed on one side with wedge shaped cut-outs 65, 66 and on its other side is supported against rollers 67, 68 which are fixed in the support belts 1, 2 and which if desired can also pass through the tension belts 3, 4 by means of posts engaging in longitudinal slots. If now the hand lever 64 is swung in the direction of arrow 69, the control bar 59 urges the tension belts 3, 4 via the wedge shaped cut-outs 65, 66 and the rivets 57, 58 in the direction of arrows 70, 71, with the rivets 57, 58 sliding in the longitudinal slots 63 of the support belts 1, 2 held by means of the transverse bar 56 and the rivets 54, 55 for their part slide in the longitudinal slots 60, 61 of the moved tension belts 3, 4.

For facilitating this tensioning process, the rivets 57, 58 can be fixed rotatably in the tension belts 3, 4 or can be provided with turnable shells.

In place of the tensioning device 53 the device illustrated in FIG. 6 can be provided, which consists of a base bar 73 e.g. firmly connected with the support belts 1, 2 via the rollers 67, 68 and a control bar 74 slidable on this, which can be so constructed as the control bars 59 of tensioning device 53 and act in the same fashion on the tension belts 3, 4 when it is pulled out in the direction of arrow 77 by turning of a pull screw spindle 75, 76, as is indicated by means of the arrow 78. On the end 79 of the spindle 75, 76 a not illustrated turning knob can engage. One can however also envisage a tensioning device 80 as is illustrated in FIG. 5. This device 80 consists of a control bar 81 arranged between supporting and tension belts 1 and 3 and directed transversely to these, which lies with wedge-shaped cut-outs 82, 83 in each case against a roller 84, 85 of the support and tensioning belts 1 and 3 and displaces both belts relative to one another in the senses of arrows 86, 87 as soon as a tension is effective on the control bar 81 in the direction of arrow 88. The 85 in this case suitably crosses the tension belt 3 via a slot 89 and holds tension and support belts 1, 3 at a distance from one another. The support belt projects with its one end 90 over the control bar 81, which in this fashion is held at least temporarily between the belts 1, 3.

In similar fashion as in the case of the device according to FIG. 4, a double control bar 59' can be arranged transversely to the tension belt 3' and surround this as shown in FIG. 4A, wherein in any case four guide rollers 57', 58', 57'', 58'' are arranged on a common base 73' in such a fashion that both the double control bar 59' and also the tension belt 3' are guided. The double control bar 59' can be connected with a tension screwed spindle 75', 76' similarly as in FIG. 6, which is anchored to base 73' and on turning its end 79' in the direction of arrow 77' a displacement of the double control bar 59' is effected in the direction of arrow 78'. By means of this the wedge-shaped aperture 65' displaces a pin 57''' of the tension belt 3 in the direction of arrow 70', so that a curvature results in the respective support belt (not illustrated).

If several base bars 73', 73'' etc. are set in a row as illustrated in FIG. 4A and as earlier described connected with one or more tension belts 3', 1' by means of distance maintenance pieces, than these base bars 73', 73'' can take over the function of support belts in which the desired curvature can be generated.

According to FIG. 5A an eccentric lever 81' can be rotatably fixed on the tension belt 3'' and can lie against an end 2' which fits against the eccentric 81'', so that on swinging the eccentric lever 81' in the direction of arrow 86' the tension belt 3'' is moved in the direction of arrow 86'', which slides by means of a post 84' in a slot 89' of the support belt 2''.

A similar sort of sliding action for the support belt 2''' is given in FIG. 5B if a lever 81'''' which passes through the tension belt 3''' with its eccentric 81''' is swung in one or other directions of arrows 86'', 86''', since the eccentric 81''' then lies in urging fashion either against one or against the other side of an aperture 65'' in the support 2'''.

According to FIG. 5C a swinging lever engages with a toothed wheel into toothing on the tension belt and on being turned in one or other direction it effects a displacement of the tension belt relative to the support belt, which in this case receives the mounting point for the swinging lever.

As an alternative to a tension screw spindle of FIG. 6 a Bowden cable 64' can be used as shown in FIG. 6A, the sleeve 64'' of which is anchored to a base and the cable 64''' of which can engage on a not illustrated control bar or directly on the tension belt. A scissors lever 53' connected with the Bowden cable can in such a case if desired be supported by means of a spindle 79" with a hand wheel.

On the other hand, according to FIG. 6B a worm drive 60' with an eccentric disc 61' can lie on a tension belt 1", which on operation of the worm drive in the direction of the arrow 77"' is displaced and in the direction of the arrow 70". The tension belt 1" is in this case guided on a base 73" via a post engaging in a slot and in the support belt 4', with which it can be connected at the non-illustrated end, a curvature is generated.

FIGS. 6C, D and E illustrate schematically that in a central displacement position of support and tension belt give a curvature over the length of the belt and that in the case of further tensioning of the tension belt a second stranger curvature can be formed in the support belt between support points and distance maintenance pieces.

Figure 7:
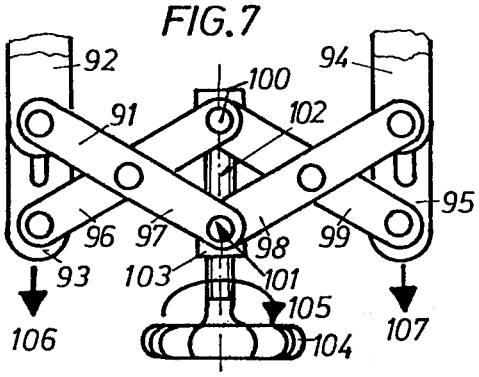

Another tensioning device 91 is to be seen in FIG. 7. On adjacent tension and support belts 92 to 95, which are superimposed, engage two scissor lever linkages 96 to 99, which in turn are connected at their connection pivoting points 100 and 101 in such a fashion with a screwed spindle 102 and a nut 103 which runs thereon that on a turning movement of the spindle handle 104 in the direction of arrow 105 the pivot positions 100, 101 move apart from one another and correspondingly the tension belts 93 and 95 are displaced in the direction of arrows 106, 107. However by means of this in the support belts 92, 94 the desired curvatures are formed, which by means of turning the spindle can not only be exactly determined in respect of their degree but can also be fixed in the adjusted position.

Figure 9:
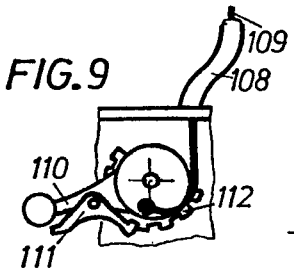

In place of the spindle 102 shown in FIG. 7, a Bowden cable 108, 109 illustrated in FIG. 9 can also engage the pivot positions 100, 101, the cable having an adjustment lever 110 and a locking pawl 111 which engages in teeth 112 associated therewith for fixing the particular adjusted position.

Figure 8:
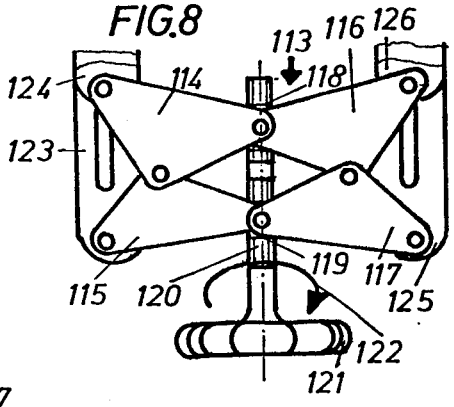

FIG. 8 illustrates a tensioning device 113 which is similar to that in FIG. 7 and which likewise has four lever linkages 114 to 117, wherein however in the connection pivot pieces constituted by nuts 118 and 119 two threads on spindle 120 which run in opposite sense engage, so that turning movement of the knob 121 in the direction of the arrow 122 has as a result movement of the nuts 118 and 119 towards one another and a contrary displacement of movement of tension and support belts 123, 124 or 125, 126.

Figure 10:
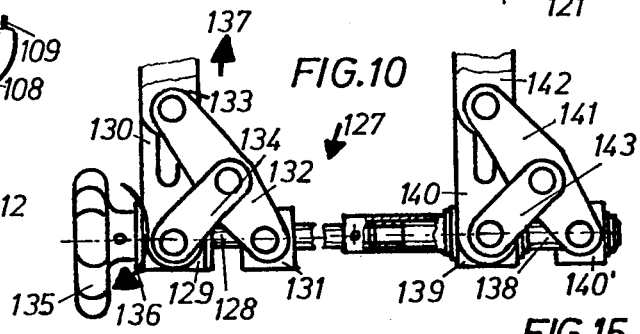

Another simply constructed but particularly effective tensioning device 127 is illustrated in FIG. 10. In this the spindle 128 passes through an end body 129 of one tension belt 130 and engages in a nut 131, which is linked to the support belt 133 in pivotal fashion by means of a tie 132. Between end body 129 and the tie 132 is a further linkage tie 134. On turning knob 135 and the spindle 128 in the direction of arrow 136, the nut 131 approaches the end body 129 of the tension belt 130, so that it leads to a displacement movement of the support belt 133 in the direction of arrow 137, because the tie 132 as a result of its linkage on the linking axis 134 transfers the movement of the nut 131 on to the support belt 133 in the form of a displacement in the direction 137. In this connection however it should be observed that, as in the case of other embodiments shown, the degree of curvature desired and holding at that point in the support belts 133 can be determined without difficulty.

If the spindle 128 is connected in non-turnable fashion with another spindle 138, an end body 139 passes through a further tension belt 130 and engages in a nut 140', which in turn is pivotally connected via a tie 141 with a further support belt 142, wherein also in this case between the tie 141 and the end body 139 there is a pivoted tie 143 engaging, then for the right hand part shown in FIG. 10 the device carries out the same movements as the left hand part if turning knob 135 is turned. In such a case, on turning the turning knob 135, the desired curvature is generated and fixed both in support belt 133 and also in support belt 132.

Figure 11:
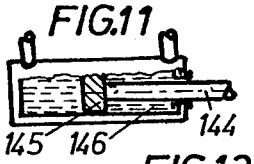

In place of a spindle 128, 138, as shown in FIG. 11, a piston rod 144 of a piston 145 may be operative, which is loaded from one or the other side in a hydraulic cylinder 146 and by means of this the control movements for forming curvatures in these support belts 133, 142 already mentioned above can be generated.

Figure 12:
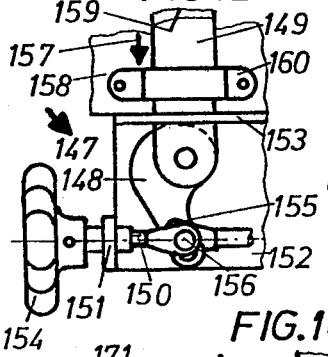
Figure 14:
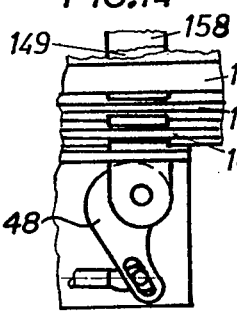
Figure 13:
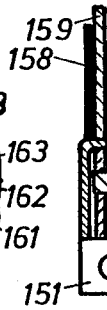

In the embodiment of a tensioning device 147 shown in FIGS. 12 and 14, an eccentric layer 148 is pivoted on the one hand with a tension belt 149 and on the other with a spindle 150, which is supported on an end piece 151 of an angled plate 152, the one shoulder of which 153 serves for supporting the eccentric lever 148. If the spindle 150 is turned by means of a hand wheel 154, then the spindle bolt 156 which engages in a slot 155 also turns the eccentric lever 158 in such a fashion that this moves the tension belt 149 in the direction of arrow 157 relative to the support belt 158 which is constructed as a plate, so that in the support belt 158 curvature is generated which indeed for its own part likewise is supported on the shoulder 153 and on its other end is connected with the tension belt 149 (not shown). A flexible intermediate layer 149 provides a distance between belts 158, 149. In this connection, on the intermediate layer 159 there can be present a guide 160 surrounding the tension belt 149.

Figure 15:
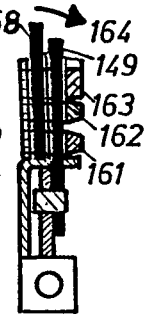

If, as illustrated in FIGS. 14 and 15, the belts 149, 158 are supported by broad cover bodies 161 to 163, which have at least partly wedge-shaped pressure faces, then the curvature in the support belt 158 on its movement in the direction of arrow 164 can be effected up until the covering bodies 161 to 163 lie against one another with their wedge-shaped support surfaces. By means of their construction, one accordingly has the possibility of determining the size and position of the curvature which ought to be formed in the broad cover bodies 161 to 163. In that place where a cover body 163 only has right angled support surfaces, the curvature in each case because of the great radius of curvature takes up a more or less extended run.

It is possible without further difficulty to construct the wedge-shaped support surfaces adjustably, so that even from this point of view the degree of curvature desired can be determined.

Figure 16:
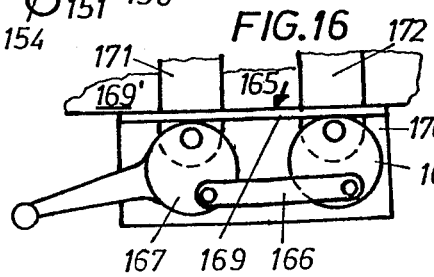

In the tensioning device 165 shown in FIG. 16 two eccentric levers 167, 168 connected by means of a tie 166 with one another are supported on the shoulder 169 of an angled plate 170 and are pivotally connected with two tension parts 171, 172 which pass through the shoulder 169 and are guided thereby. The support belt which lies under them and which constitutes a single plate 169' lies in contrast only against the shoulder 169 and constitutes depending upon the degree of swinging of the eccentric levers 167 a more or less large curvature. In place of plate 169', belts can also be provided in which the desired curvature is generated.

How eccentric levers 167 and 168 cooperate is obvious and obvious also is that pivotal connection of the eccentric levers of the devices of FIGS. 12 and 14 with one another is also possible.

Figure 17:
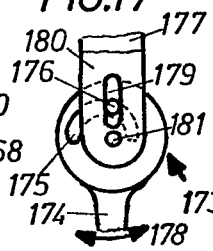

According to a further embodiment of the invention which is illustrated in FIG. 17, a tensioning device 173 consists of an eccentric lever 174 which an eccentrically arranged slot 175, in which a post 176 of the tension belt 177 engages, which on turning the eccentric lever 174 in the direction of arrow 178 moves in the arcuate slot 175 and also along the longitudinal slot 179 of the support belt 180, so that between tension and support belt 177 and 180 a contrary-wise displacement takes place, since the support belt 180 is fixed at the turning point 181 of the lever 174. Also this displacement of the tension belt 177 leads to a more or less great curvature in the support belt 180, the exact amount depending upon how far lever 174 is swung.

Figure 19:
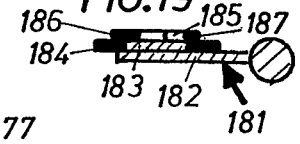
Figure 18:
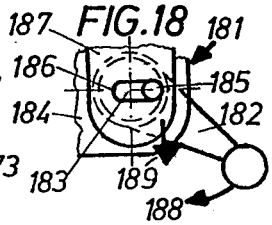

A further tensioning device 181 illustrated in FIGS. 18 and 19 likewise has an eccentric lever 182 which engages with a circular disc 183 in a corresponding aperture of the support belt 184. On the disc 183 there sits eccentrically a post 185, which in its turn engages in a transverse slot 186 of the tension belt 187. On a swinging movement of lever 182 in the direction of the arrow 188 the post 185 slides in the transverse slot 186 while simultaneously taking the tension belt 187 in the direction of of arrow 189, so that in this case the support belt 184 which is constructed as a plate is curved strongly depending upon how far lever 182 is swung.

Figure 20:
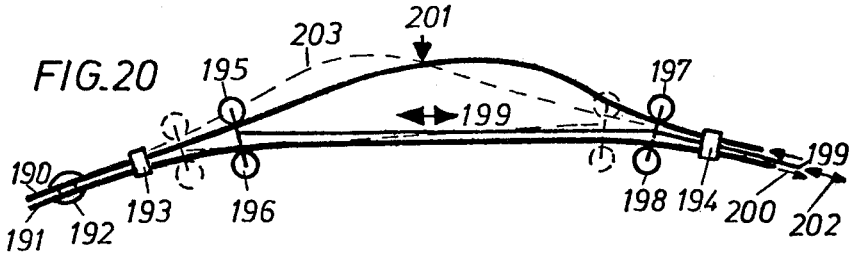
FIGS. 20 to 24 show schematically and in side view further embodiments of a support according to the invention.

From FIG. 20 a particularly simply set curvature of a support according to the present invention is evident. Support and tension belt 190, 191 are fixedly connected to one another at one end by means of a rivet 192 or the like. Two or more distance maintenance pieces 193, 194 can embrace the belts 190, 191 loosely or fixedly. Further distance separation pieces in the form of roller pairs which are held together 195, 196, 197, 198 are displaceable on the belts 190, 191 by means of an additional stiff control belt 199, which engages on both roller pairs 195 to 198 and can be guided between support and tension belts 190, 191. If via the tension belt 191 a pull in the direction of arrow 200 is exercised on the support, then a curvature 201 forms in the support belt 190 between the roller pairs, which however can be displaced via the control belt 199 according to its movement in one or the other direction (arrow 202). The curvatures located furthest apart which can be formed by displacement are illustrated with an unbroken line 201 and with a dashed line 203. The control belt 199 can be connected with a non-illustrated handle, or can be driven by means of a motor hydraulically electromagnetically or the like. Since the roller pairs 195 to 198 on their adjustment on the belts 190, 191 have only a small rolling resistance, their adjustment is even still possible if the curvature 201 in the support belt 190 is very strongly pronounced.

Figure 21:
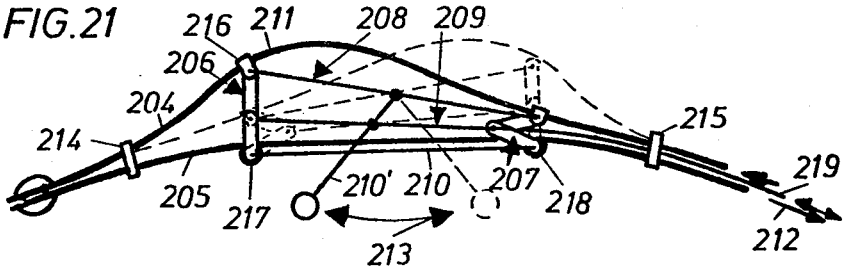

Another type of adjustment of such curvature within the support belt is illustrated in FIG. 21. In this case between the support and tension belt 204 and 205 pairs of knee-levers 206, 207 are so fixed as distance maintenance pieces and are connected with one another by means of arms 208, 209 and 210, that with a handle 210' which is swingable on the arms 208, 209, one knee-lever is extended and the other is folded up.

In the position illustrated the knee-lever 206 is extended so that the curvature 211 is constituted on the left-hand side of the support belt 204 as shown in FIG. 21, after a force in the direction of arrow 212 was effective on tension belt 205.

By swinging the handle 210 in the direction of arrow 213 the knee-lever 206 is folded up and the other knee-lever 207 is extended, as illustrated by dashed lines. By means of this a displacement of the curvature 211 takes place towards the right hand side of the support belt 204 as seen in FIG. 21, which likewise is set out in dashed lines.

The one distance maintenance piece 214 located on the fixed ends of belts 204, 205 can be fixed irremovably on this. The other distance maintenance piece 215 is advantageously only firmly connected with support belt 204, the support 205 in contrast can slide in distance maintenance piece 215.

The one knee lever 206 is fixed on support belt 204 by means of its tie 216. On the underside of the tension belt 205, the knee levers 206, 207 engage however with rollers 217 and 218 which create equilibrium movement if tension and support belts are slid relative to one another.

A control belt 219 operable from outside can also engage on knee lever 207, which can be controlled as control belt 199 in FIG. 20.

Figure 22:
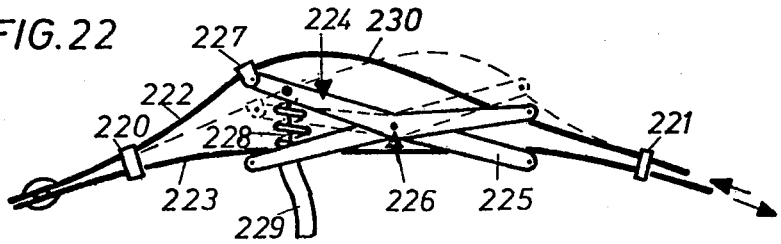

On the support and tension belts 222 to 223 which are illustrated in FIG. 22 and held together by distance maintenance pieces 220 and 221, scissor levers 224, 225 engage with their ends which are pivotally connected with one another at 226. A Bowden cable 228 engages with a lever 224 which is fixed by means of a tie 227 to the support belt 222, the outer sleeve 229 of which Bowden cable is supported on the other lever 225. By operating the Bowden cable 228, as is evident from the dashed lines, the curvature 230 produced in support belt 222 is displaced to the right as seen in FIG. 22, because the scissor levers 224, 225 are on one side brought closer to one another and on the other side moved apart from one another. In place of the Bowden cable, there can naturally bear against the respective lever ends also a screw, an eccentric or the like.

Figure 23:
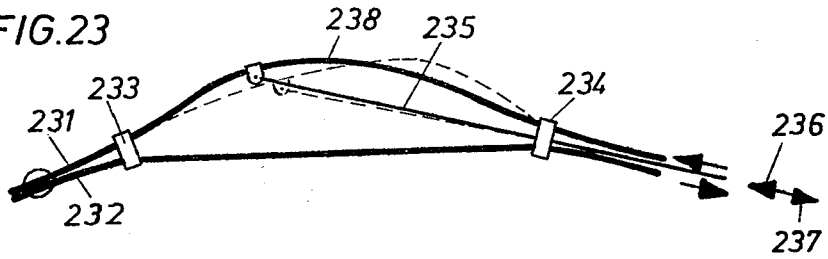
Figure 24:
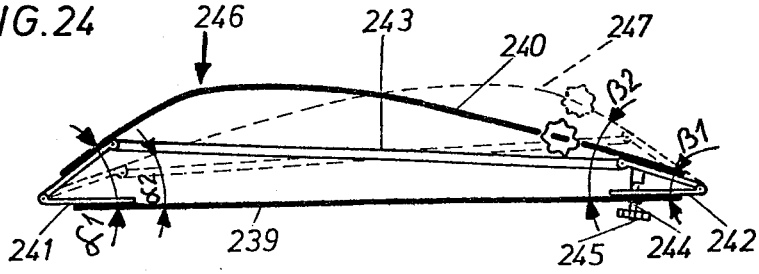

A particularly simple embodiment of the invention is produced if, as seen in FIG. 23, between tension and support belts 231, 232 which as described above are connected together at one end, and which are held together by means of distance maintenance pieces 233, 234, there is arranged a stiff control belt 235 engaging on the support belt 231, by tension or pressure of which in one or the other direction 236, 237 a curvature 238 generated in support belt 231 by means of the tension belt 232 can be displaced. The displacement of curvature which is taken place to the right as shown in FIG. 23 is illustrated with dashed lines. According to the embodiment of FIG. 24, the tension and support belts 239, 240 are firmly connected at their ends in each case with a hinge 241, 242, wherein the upper hinge parts are collected by means of a linkage arm 243. On the one hinge 242 engages a screwed spindle 244 with a grip 245, on turning which in the one direction the angle $\beta_1$ between the hinge parts, and accordingly the ends of the tension and support belts 239, 240 can be adjusted to a greater value e.g. $\beta_2$. On such adjustment, the angle $\alpha_1$ between the parts of the other hinge 241 also varies to a smaller value namely $\alpha_2$, so that the curvature 246 previously formed in the support belt 240 is displaced on to the other side of the support according to the invention, as is illustrated by dashed lines 247. It is clear that depending upon the turning of screwed spindle 244, any desired intermediate position and accordingly every position for the curvature can be achieved between the two extreme positions illustrated.

Figure 25:
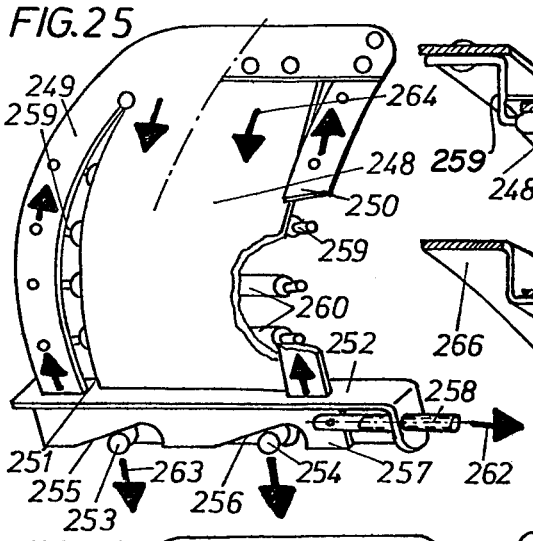
FIGS. 25 to 29 illustrate in perspective further variants of the support according to the invention in the form of seat backs.

In the embodiment of the invention illustrated in FIG. 25, an averagely broad tension belt 248 is unitarily connected with two lateral support belts 249, 250 at the upper end, and below having an end passing through a slot 251 of an angle piece 252, but provided with pins 253, 254, which lie against wedge-shaped cut-outs 255, 256 of a slider 257 which is supported on the long shoulder of the angle piece 252 from below and engages with a screwed spindle 258 in a thread of the short shoulder of the angled piece 252. On the upper side of the long shoulder of the angle piece 252 there are supported the free ends of the support belts 249, 250. On their rear side U-shaped bows 259 with rollers 260 or slide pieces 261 are provided against which the tension belt 248 lies (see FIG. 26).

Figure 26:
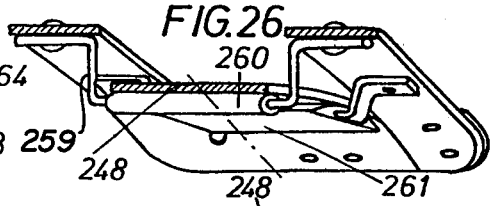

If the spindle 258 is turned and moved in the direction of the arrow 262, the posts 253, 254 are displaced in the direction of arrows 263 so that the tension belt 248 which lies against the rollers 260 is likewise moved downwardly (arrow 264) wherein any curvature already previously present in the support belts 248 is increased (FIG. 26).

Figure 27:
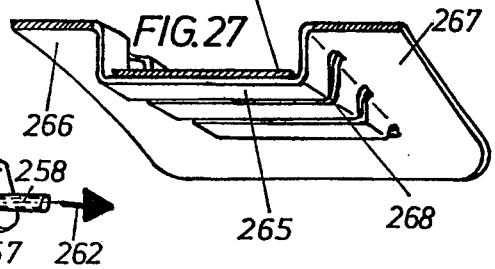

According to FIG. 27, the bow 25 may constitute a unit with the support belts 266, 267 and slits 268 may be formed between them which are so broad that on tensioning the tension belt 248 which slides on the bows 265, i.e. on achieving the greatest possible curvature of the supports belts 266, 267, they are closed up. The bars of these bows 265 bear on one another accordingly in the most curved position of the support.

Figure 28:
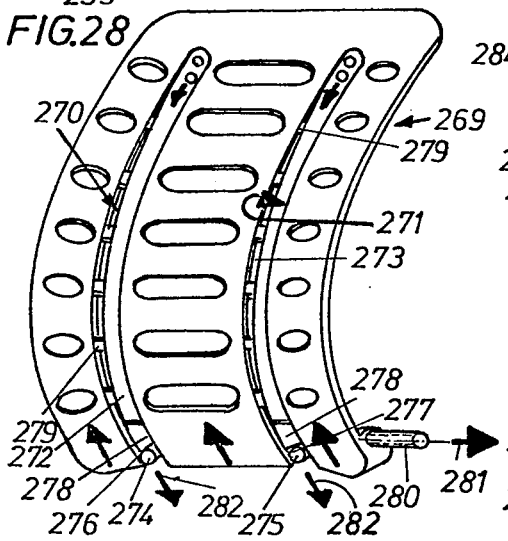

The support according to the invention and shown in FIG. 28 consists of a body 269 in the shape of a seat back and formed of plywood, metal, plastics or the like which can be injection moulded, drawn or stamped. It has cut-outs 270, 271 directed from above to below in which tension belts 272, 273 are installed which are fixed at their upper ends to the body 269 and which have at their lower free ends posts 274, 275 which, as in the embodiment of the invention shown in FIG. 25, lie against wedge-shaped cut-outs 276, 277 on a slider 278, which is supported and guided in the lower part of body 269.

Provided on the rear side of body 269 are bows 279 which serve as a support for the tension belts 272, 273. If accordingly the screwed spindle 280 which is connected with the slider 278 and which engages in a thread in body 269 is turned and moved in the direction of arrow 281, this produces via the pins 274, 275 and the apertures 276, 277 of the slider 278 a movement of the tension belts 272, 273 in the direction of arrows 282, so that these tension belts 272, 273 which are supported by bows 279 are tensioned. Their tensioning effects a further bending of the body 269, which can already have a certain curvature.

Figure 29:
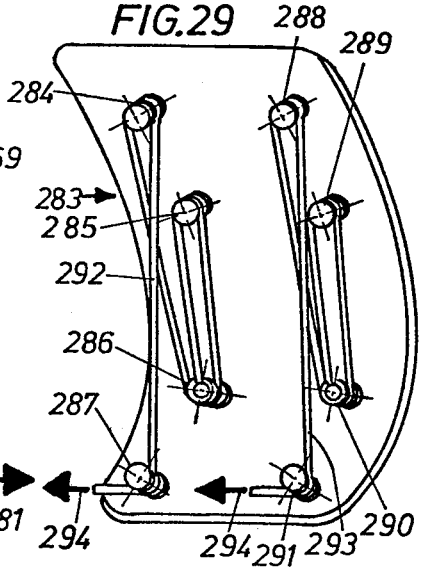

A yet simpler way of constructing the invention is illustrated in FIG. 29. An initially already curved support 283 has on its rear side arranged in one or more vertical rows rollers 284 to 291, around which tension belts 292, 293 are so guided that their one ends are fixed to rollers 286 or 290 and they are laid around the other rollers 285, 286, 284 and 287 or 289, 290, 288 and 291 respectively e.g. in zig-zag shape and led away in the lower region of the support 283 substantially horizontally to a tensioning device not illustrated.

If a pulling force is applied to the lower ends of the tension belts 292, 293 in the direction of arrows 294, then as a result of the winding around of the rollers which lie above one another, they approach one another and accordingly generate further curvature of support 283 which can naturally be exactly adjusted to the desired degree of curvature and fixed in that position.

By means of the rollers or sliding elements on the distance maintenance pieces described in the description of embodiments of FIGS. 2, 3, 20, 23 and 29, or by means e.g. of reciprocally acting knee-levers, scissors-levers, linkages or the like (FIGS. 21, 22, 24, 25, 27 and 28) but also by means of additional tensioning of pressing elements (FIG. 23) the curvature within the supports according to the invention, and accordingly also within a seat, bridge, concrete construction or carrying support into which the support is built can be displaced with a small additional "secondary force" even with partial or total loading of the support at the time.

All or some of the supports can also have overall or individually support, pressure or tensioning elements, distance maintenance pieces, tensioning or control mechanisms or have, by additional springs or spring elements, right from the beginning one or more "individual curvatures" into which the support will of itself return as soon as the influence exercised by a tensioning device falls away. By means of this the alteration and/or displacement of one or more curvatures can be generated by "relaxation" in place of by tensioning, pulling or pressure forces, or can also be changed by external influences (e.g. leaning on it) so that now "fixing" of the particular curvature can take place e.g. by clamping, by means of a cross-bar or by light subsequent turning or relaxation of the control or tensioning device. All the mentioned features of the invention are accordingly combinable with one another or exchangeable according to will and also combinable or exchangeable with any other constructional elements (directly or via damping or other auxiliary means).

In FIG. 30 a tensioning device 295 is illustrated which corresponds essentially to that of FIG. 1, up to the leaf springs 296, 297 which have a characteristic concave shape. Springs 296, 297 have indeed a precurvature directed inwardly (dash-dot lines) but by means of stops or other hindrance they cannot move together. The starting position for longitudinal loading is slight opposite curvatures directed towards one another. On further loading in their longitudinal direction, the springs can only spring out against their inherent curvature (which is shown in the dash-dotted line) to the dashed line type of position. After they have sprung out in this way, they have an inverted characteristic curvature. If the springs 296, 296 lie via the connection members 298, 299 against the ties of tensioning devive 295, then this is supported in its action. The same effect may be achieved by means of the S-shaped spring 300 which engages on the individual parts of tensioning device 295.

According to the embodiment of FIG. 31, corresponding S-shaped spring 301 engages on the knee-levers of a similar tensioning device 302 and supports this in its action, which support can naturally take place in one or the other direction.

I claim:

1. A flexible elastic supporting structure comprising:

an elongate flexible and longitudinally substantially inextensible and incompressible band forming a support belt;

an elongate flexible and generally flat element forming a tension belt secured at a first end thereof to a first end of said band, said support and tension belts having mutually confronting broad sides and extending generally codirectionally with each other;

retaining means engaging second ends of said belts for holding said second ends close to each other while maintaining said tension belt under stress whereby a convex curvature away from said tension belt is imparted to said support belt with a peak at an unrestrained central portion thereof; and manually displaceable adjustment means coupled with said support belt at a fixed intermediate location disposed between one of said ends thereof and said unrestrained central portion for varying the spacing of said belts from each other at said location, thereby modifying said convex curvature with a shift of said peak in a range lying between said location and said retaining means.

2. A supporting structure as defined in claim 1 wherein said intermediate location lies closer to said first end of said support belt, said adjustment means comprising a stiff control belt engaging said support belt at said intermediate location and traversing said retaining means between said second ends of said support and tension belts.

3. A supporting structure as defined in claim 1 or 2, further comprising additional retaining means limiting the separation of said support and tension belts from each other at a point between said first ends thereof and said intermediate location.

4. A supporting structure as defined in claim 1 wherein said adjustment means comprises two members anchored to said tension belt, one of said members engaging said support belt at said intermediate location, the other of said members engaging said support belt at another location disposed between said central portion and the other of said ends and separated from said intermediate location by the peak of said convex cuvature, said members being mechanically interconnected for inversely varying the spacing of said belts from each other at said locations.

5. A supporting structure as defined in claim 4 wherein said members are pairs of elbow levers having corresponding extremities interlinked for folding one pair upon a straightening of the other pair.

6. A supporting structure as defined in claim 4 wherein said members are pivotally interconnected scissor levers.

7. A supporting structure as defined in claim 4 wherein said belts are secured to each other at said first ends by a first hinge, said retaining means comprising a second hinge, said hinges having vertex angles pointing away from each other, said members being part of said first and second hinges, respectively.

* * * * *